US008152449B2

(12) United States Patent
Saville et al.

(10) Patent No.: US 8,152,449 B2
(45) Date of Patent: Apr. 10, 2012

(54) VACUUM GENERATOR SEAL

(75) Inventors: Marshall Saville, Torrance, CA (US); Deborah Osborne, Redondo Beach, CA (US)

(73) Assignee: Honeywell International Inc., Morristown, NJ (US)

( * ) Notice: Subject to any disclaimer, the term of this patent is extended or adjusted under 35 U.S.C. 154(b) by 652 days.

(21) Appl. No.: 12/331,790

(22) Filed: Dec. 10, 2008

(65) Prior Publication Data

US 2010/0143091 A1 Jun. 10, 2010

(51) Int. Cl.
*F01D 11/00* (2006.01)

(52) U.S. Cl. ..... 415/112

(58) Field of Classification Search ..... 415/110, 415/108, 109, 111, 112; 384/472–475, 477–489
See application file for complete search history.

(56) References Cited

U.S. PATENT DOCUMENTS

| | | | | |
|---|---|---|---|---|
| 2,970,777 | A | 2/1961 | Hardy et al. | |
| 5,489,187 | A * | 2/1996 | Ray | 415/111 |
| 5,713,719 | A * | 2/1998 | Fiore et al. | 415/58.2 |
| 6,599,020 | B2 | 7/2003 | Obara | |
| 6,659,228 | B2 * | 12/2003 | Wolf et al. | 184/12 |
| 6,966,746 | B2 | 11/2005 | Cardenas et al. | |
| 7,001,148 | B2 | 2/2006 | Cardenas et al. | |
| 7,008,177 | B2 * | 3/2006 | Britt et al. | 415/111 |
| 7,337,764 | B2 | 3/2008 | Pringle et al. | |
| 7,354,009 | B2 | 4/2008 | Keener | |
| 2005/0147491 | A1 * | 7/2005 | Loyd et al. | 415/111 |

FOREIGN PATENT DOCUMENTS

WO WO2005035447 A2 4/2005

OTHER PUBLICATIONS

AOA-Gauting Brochure available from http://www.aoa-gauting.de/frame_en.html.

* cited by examiner

*Primary Examiner* — Ross Gushi
(74) *Attorney, Agent, or Firm* — Michael Shimokaji, Esq.

(57) ABSTRACT

A vacuum generator seal can comprise an upstream annular cavity adjacent to the upstream side of the bearing, a downstream annular cavity adjacent to the downstream side of the bearing, and at least one drain slot positioned on the upstream side of the bearing housing. The vacuum generator seal can include a retainer that at least partially defines the upstream annular cavity. The retainer may be in contact with the bearing housing and may have a tight clearance with the impeller hub. The retainer along with a supply of grease packed within the annular cavities can seal the bearing; and the drain slot can direct water and waste away from the bearing and towards the scroll.

18 Claims, 3 Drawing Sheets

VACUUM GENERATOR SEAL

CROSS-REFERENCE TO RELATED APPLICATION

The present application is related to U.S. Pat. No. 6,966,746, issued Nov. 22, 2005, which is incorporated herein by reference.

BACKGROUND OF THE INVENTION

The present invention generally relates to a rotating machine, and, more particularly, to a method and apparatus to prevent water or waste migration to the bearings of the rotating machine.

The bearings are important components of many rotating machines, such as vacuum blowers used in aircraft waste systems. The pressure differential created by the rotating machine and/or the orientation of the unit as installed in the system can lead to water or waste ingestion by the bearings. The water or waste ingestion can wash the grease out of the bearings resulting in premature bearing failure. Methods of sealing bearings have been described.

In U.S. Pat. No. 6,599,020, a double seal bearing is disclosed. The described assembly includes a pair of annular inner and outer sealing plates having respective central openings with a remaining slight clearance between each respective sealing plate and one of the inner and outer races, respectively, so as to assure the labyrinth seal function. Although the described assembly may reduce water or waste ingestion, the assembly may not be suitable for all applications and can increase manufacturing complexity.

In U.S. Pat. No. 7,337,764, a method of pressure balancing across a bearing adjacent to a pressure differential is described. The method primarily includes providing a bypass port around the bearing for allowing a fluid flow from a first pressure side to a second pressure side. Although the described method may reduce the pressure differentials that can force contaminants into the bearing as well as force lubricant out of the bearing, the '764 patent lacks a method for sealing the bearings.

As can be seen, there is a need for improved an apparatus and method to prevent water or waste migration to the bearings of a rotating machine. Further, an assembly is needed that can provide improved bearing sealing.

SUMMARY OF THE INVENTION

In one aspect of the present invention, an assembly for a bearing having a bearing housing comprises an upstream annular cavity positioned upstream from and in contact with the bearing; a retainer in contact with the bearing housing, the retainer at least partially defines the upstream annular cavity; and a supply of grease positioned within the upstream annular cavity.

In another aspect of the present invention, an assembly for a rotating machine having a bearing and an impeller comprises at least one drain slot machined into a housing of the bearing, the drain slot extending outward from a bearing housing depression in said housing and towards a scroll that leads to the outlet of the unit.

In a further aspect of the present invention, a method of preventing the migration of a supply of contaminants into a bearing of a rotating machine comprises the steps of sealing an upstream side of the bearing; and directing the supply of contaminants away from the bearing.

These and other features, aspects and advantages of the present invention will become better understood with reference to the following drawings, description and claims.

DETAILED DESCRIPTION OF THE INVENTION

Figure 1:
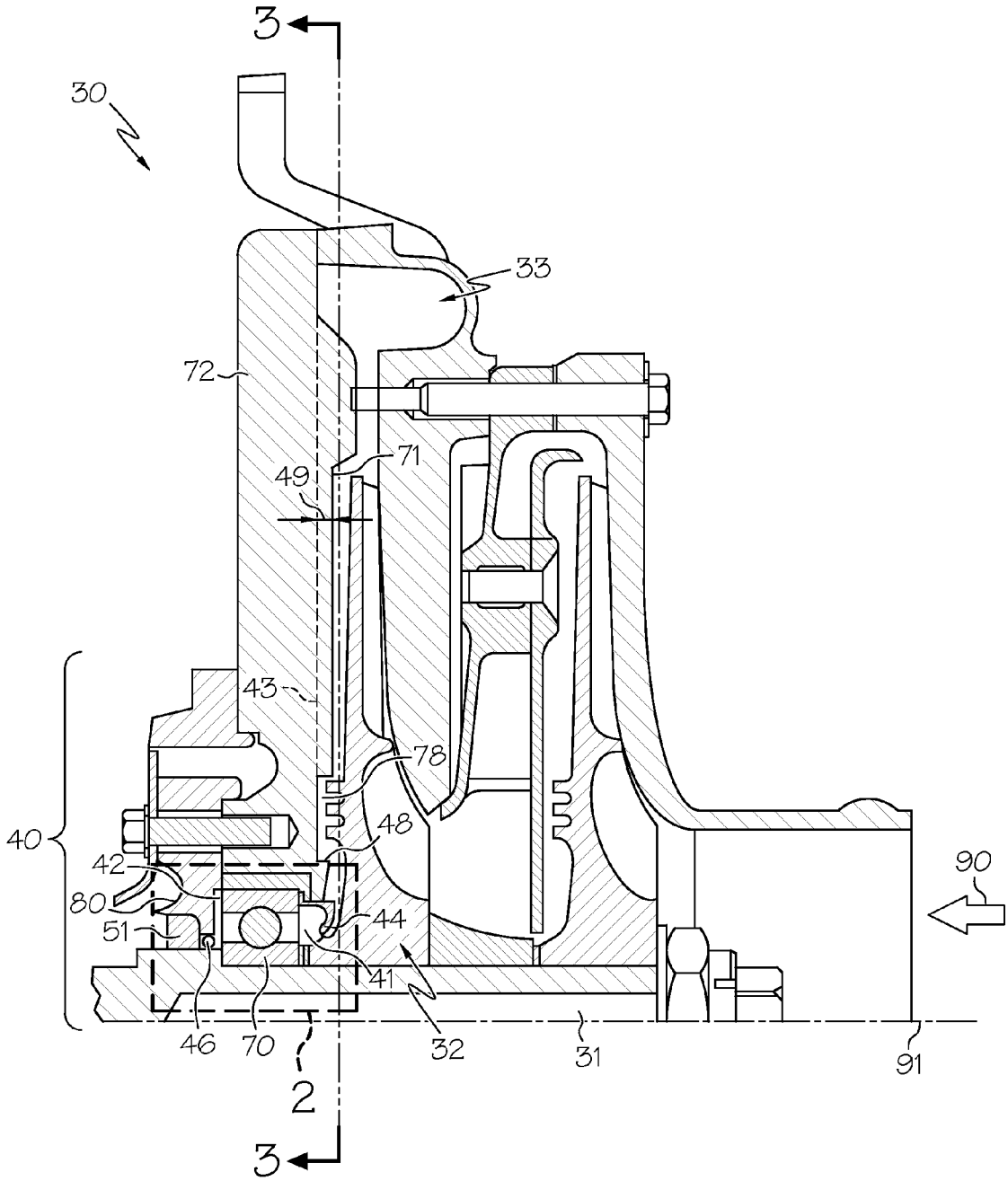
FIG. 1 is a perspective view of a migration prevention assembly according to one embodiment of the present invention installed on a rotating machine.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Broadly, the present invention provides assemblies for bearings of rotating machines, such as vacuum generators, and methods for preventing water or waste migration to the bearings. Embodiments of the present invention may find beneficial use in many industries including aerospace, automotive, and electricity generation. The present invention may be beneficial in applications including manufacturing and repair of aerospace components. Embodiments of the present invention may be beneficial in applications including generators, motors, and motor/generators. Embodiments of the present invention may be beneficial in applications including pneumatic equipment for pressurizing tanks, refueling operations, and generating vacuum. Embodiments of the present invention may be useful in any rotating machine application including, but not limited to, vacuum generators.

In one embodiment, the present invention provides an upstream annular cavity adjacent to the upstream side of the bearing, a downstream annular cavity adjacent to the downstream side of the bearing, and at least one drain slot positioned on the upstream side of the bearing housing. The present invention may include a retainer that at least partially defines the upstream annular cavity. The retainer may be in contact with the bearing housing and may have a tight clearance with the impeller hub. The retainer along with a supply of grease packed within the annular cavities can seal the bearing; and the drain slot can direct water and waste away from the bearing and towards the scroll of the rotating machine. The tight clearance of the retainer with the impeller hub may protect the bearing and the grease within the upstream annular cavity may provide additional protection to ward off any trickle of water/waste that might enter through the tight clearance between the retainer and the impeller hub. Unlike the prior art that includes inner and outer sealing plates, embodiments of the present invention can include grease packed annular cavities at least partially defined by the ball bearing, the bearing housing, the bearing seal housing, an o-ring, and the retainer.

Unlike the prior art that includes a bypass port around the bearing to reduce the pressure differentials that can force contaminants into the bearing, embodiments of the present invention can include drain slots to direct the contaminants away from the bearings and into the scroll where the contaminants then can drain out through the scroll discharge.

A migration prevention assembly 40 according to an embodiment of the present invention is shown in FIG. 1. FIG. 1 depicts the assembly 40 installed on a rotating machine 30. The assembly 40 may include an upstream annular cavity 41, a downstream annular cavity 42, and at least one drain slot 43. The assembly 40 may include a retainer 44 that at least partially defines the upstream annular cavity 41. The assembly 40 also may include an o-ring 46, a bearing seal 51 and a bearing seal housing 80. The down stream annular cavity 42 may be defined at least partially by the o-ring 46 and the bearing seal housing 80.

The upstream annular cavity 41 may be adjacent to and upstream from a bearing 70. The downstream annular cavity 42 may be adjacent to and downstream from the bearing 70. The upstream annular cavity 41 and the downstream annular cavity 42 each may be packed with grease (not shown). Upstream and downstream may be defined with reference to a flow 90 through the rotating machine 30 along an axis 91. The drain slots 43 may be positioned on an upstream facing side 71 (impeller facing side) of a bearing housing 72 and may extend from a bearing housing depression 78 to a scroll 33.

The rotating machine 30 is depicted as a vacuum generator in FIG. 1, but the present invention is not so limited and may be useful with other rotating machines 30. In addition to vacuum generators for sanitation systems, other useful rotating machines 30 may include pneumatic equipment for pressurizing tanks and refueling operations. Embodiments of the present invention may be useful with any vacuum blower application wherein fluid contamination is a concern.

Figure 2:
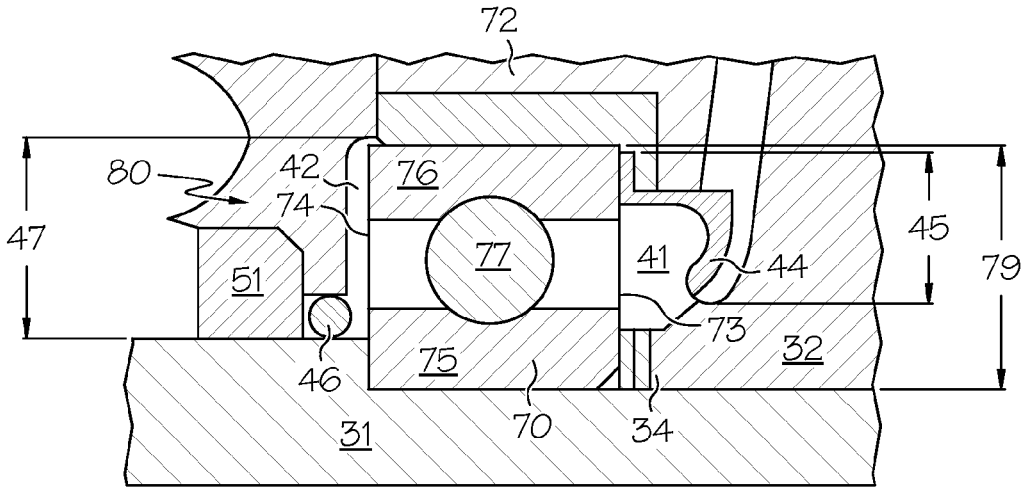
FIG. 2 is a close-up view of area 2 of FIG. 1.

The upstream annular cavity 41 may comprise a void adjacent to and upstream from the bearing 70, as depicted in FIG. 2. The bearing 70 may include an inner race 75, an outer race 76 and a rolling element 77. The inner race 75 may be adjacent to and surround a shaft 31 of the rotating machine 30. The upstream annular cavity 41 may be at least partially defined by a bearing upstream side 73 and the retainer 44.

The retainer 44 may comprise a flange shaped structure positioned upstream from the bearing 70 and in contact with the bearing housing 72. The retainer 44 may comprise a machined component pressed into the bearing housing 72. Alternatively, the retainer 44 may be integral to the bearing housing 72. A retainer radial length 45 may be at least about 50% of a bearing radial length 79, as depicted in FIG. 2. For example, for some aircraft sanitation applications wherein the bearing radial length 79 is about 0.500 inches, the retainer radial length 45 may be between about 0.125 inches and about 0.375 inches.

The retainer 44 may be positioned near an impeller 32 of the rotating machine 30. The retainer 44 may be pressed near a hub 34 of the impeller 32. For some embodiments, the retainer 44, the impeller hub 34, and the bearing upstream side 73 may define the upstream annular cavity 41. The positioning of the retainer 44 may allow for a slight clearance between the impeller hub 34 and the retainer 44 to prevent these components from galling together. For some vacuum generator applications, the retainer 44 may have a radial clearance with the impeller hub 34 of less than about 0.005 inches. For some applications, the retainer 44 may have a radial clearance with the impeller hub 34 between about 0.0001 inches and about 0.010 inches.

The retainer 44 may be designed to at least partially define the upstream annular cavity 41. The retainer 44 may be adapted such that a supply of grease (not shown) may be positioned within the upstream annular cavity 41. The supply of grease may comprise a hydrophobic grease. The supply of grease may be compatible to the grease of the bearing 70.

During operation the grease within the upstream annular cavity 41 may seal the bearing upstream side 73 and prevent water and waste from entering the bearing 70. For some embodiments, it may be that the retainer 44 may actually seal the bearing 70. The tight clearance of the retainer 44 with the impeller hub 34 may be what is protecting the bearing 70 from the pressure differential during operation and from water/waste from flooding the bearing 70. The grease within the upstream annular cavity 41 then may ward off any trickle of water/waste that might enter through the tight clearance between the retainer 44 and the impeller hub 34. In addition to the upstream annular cavity 41, some embodiments of the present invention may include the downstream annular cavity 42.

The downstream annular cavity 42 may comprise a void adjacent to and downstream from the bearing 70, as depicted in FIG. 2. The downstream annular cavity 42 may be at least partially defined by the o-ring 46. For some embodiments, the downstream annular cavity 42 may be at least partially defined by a bearing downstream side 74, the bearing seal housing 80 and the o-ring 46. The o-ring 46 may be positioned downstream from the bearing 70 and in contact with the bearing seal housing 80 and the shaft 31 of the rotating machine 30. The positioning of the o-ring 46 may allow for a slight clearance between the shaft 31 and the o-ring 46.

For some embodiments, a downstream cavity radial length 47 may be about equal to the bearing radial length 79. For some embodiments, the bearing 70 may be partially set into the shaft 31, as depicted in FIG. 2, and the downstream cavity radial length 47 may be less than the bearing radial length 79. For example, for some aircraft sanitation applications wherein the bearing radial length 79 is about 0.500 inches, the downstream cavity radial length 47 may be between about 0.125 inches and about 0.375 inches.

The assembly 40 may be designed such that a supply of grease (not shown) may be positioned within the downstream annular cavity 42. The supply of grease may comprise a hydrophobic grease. The supply of grease may be compatible to the grease of the bearing 70. During operation the grease within the downstream annular cavity 42 may seal the bearing downstream side 74 to prevent water and waste from entering the bearing 70.

Figure 3:
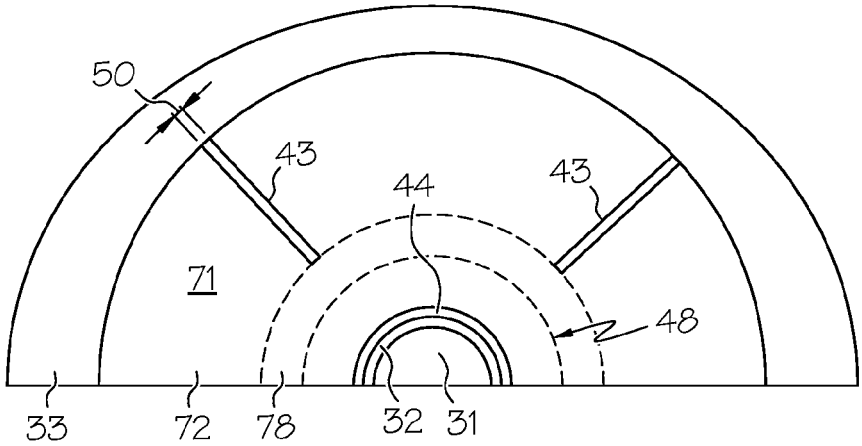
FIG. 3 is a view through line 3-3 of FIG. 1.

The assembly 40 may include at least one drain slot 43, as depicted in FIG. 1. For some aircraft applications, the assembly 40 may include between about one and about twenty drain slots 43. The drain slot 43 may be machined into the bearing housing 72. The drain slot 43 may be positioned on the upstream facing side (impeller facing side) 71 of the bearing housing 72. The drain slot 43 may extend from the bearing housing depression 78 to the scroll 33, as depicted in FIGS. 1 and 3. The bearing housing depression 78 may comprise a housing/impeller interface seal pocket. During operation or due to the orientation of the unit during periods of non-operation, water and waste may accumulate in the bearing housing depression 78. The drain slot 43 may be designed such that water and waste within the bearing housing depression 78 is directed away from the bearing 70. The drain slot 43 may be adapted to prevent water and waste within the bearing housing depression 78 from overflowing an inner radial wall 48 (see FIGS. 1 and 3) of the bearing housing depression 78.

Figure 4:
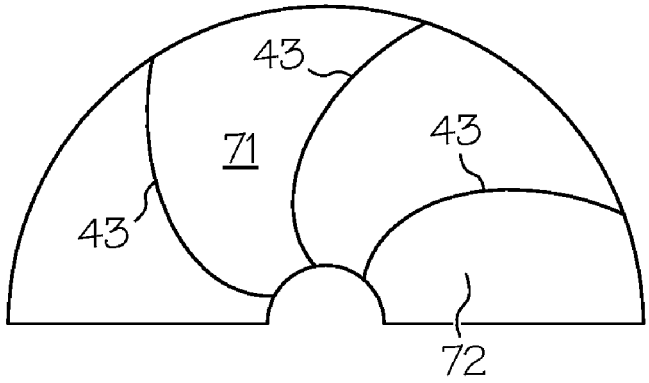
FIG. 4 is a plan view of a partial bearing housing according to one embodiment of the present invention.
Figure 5:
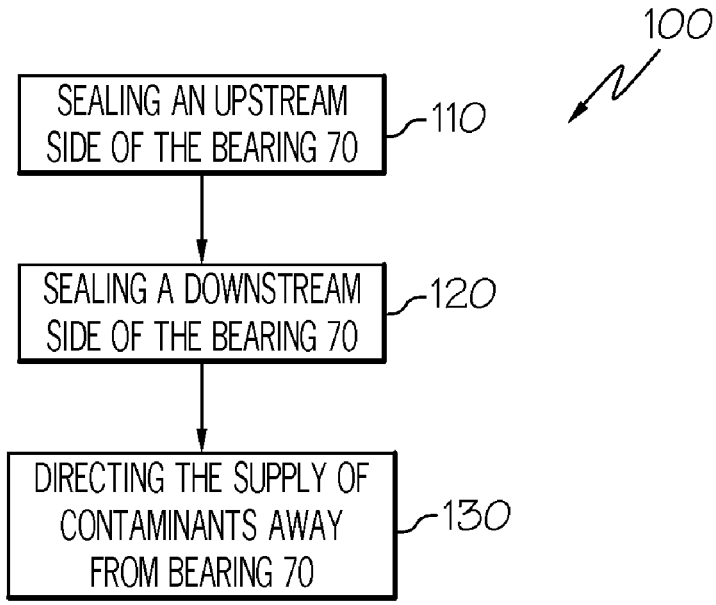
FIG. 5 is a flow chart of a method of preventing the migration of a supply of contaminants into a bearing of a rotating machine according to an embodiment of the present invention.

The drain slot 43 may extend radially outward, as depicted in FIG. 3. Alternatively, the drain slot 43 may extend spirally, as depicted in FIG. 4. For some applications, the drain slot 43 may extend spirally in the direction of rotation of the impeller 32. For some applications, spirally extending drain slots may be more efficient than radially extending drain slots; however, the radially extending drain slots may be less costly to manufacture. For some applications, the drain slot 43 may extend about perpendicular to the axis 91. Alternatively, the drain slot 43 may be cantered.

The dimensions of the drain slot 43 may vary with application. The dimensions of the drain slot 43 may be small enough to avoid impacting the performance the rotating machine 30. The dimensions of the drain slot 43 may be large enough to promote the capillary effect and prevent drain slot plugging. For some applications, a slot depth 49 (see FIG. 1) may be at least about 0.001 inch. For some aircraft sanitation applications, the slot depth 49 may be between about 0.001 inches and about 0.250 inches. For some applications, a slot width 50 (see FIG. 3) may be at least about 0.001 inch. For some aircraft sanitation applications, the slot width 50 may be between about 0.001 inches and about 0.250 inches.

Some embodiments of the present invention may include the upstream annular cavity 41. Some embodiments of the present invention may include the upstream annular cavity 41 and the downstream annular cavity 42. Some embodiments of the present invention may include at least one drain slot 43. Some embodiments of the present invention may include the upstream annular cavity 41 and at least one drain slot 43. Some embodiments of the present invention may include the upstream annular cavity 41, the downstream annular cavity 42 and at least one drain slot 43.

A method 100 of preventing the migration of a supply of contaminants into a bearing of a rotating machine is depicted in FIG. 4. The method 100 may comprise a step 110 of sealing an upstream side of the bearing 70; a step 120 of sealing a downstream side of the bearing 70; and a step 130 of directing the supply of contaminants away from the bearing 70.

The step 110 of sealing an upstream side of the bearing 70 may comprise positioning a supply of grease in an upstream annular cavity 41. The step 110 of sealing an upstream side of the bearing 70 may comprise positioning a supply of grease between and in contact with the bearing 70 and a retainer 44. The step 110 of sealing an upstream side of the bearing 70 may include positioning a retainer 44 in contact with a housing 72 of the bearing 70 such that the retainer 44 has a tight clearance with an impeller hub 34 of the rotating machine. As defined herein, a tight radial clearance may be less than about 0.005 inches. For some applications, the step 110 of sealing an upstream side of the bearing 70 may include positioning a retainer 44 in contact with a housing 72 of the bearing 70 such that the retainer 44 has a radial clearance with an impeller hub 34 of the rotating machine of less than about 0.005 inches. For some applications, the step 110 of sealing an upstream side of the bearing 70 may include positioning a retainer 44 in contact with a housing 72 of the bearing 70 such that the retainer 44 has a radial clearance with an impeller hub 34 of the rotating machine between about 0.0001 inches and about 0.010 inches.

The step 120 of sealing a downstream side of the bearing 70 may comprise positioning a supply of grease in a downstream annular cavity 42. The step 120 of sealing a downstream side of the bearing 70 may comprise positioning a supply of grease between and in contact with the bearing 70, an o-ring 46, and the bearing seal housing 80. The step 120 of sealing a downstream side of the bearing 70 may comprise positioning a supply of grease within a downstream annular cavity 42.

The step 130 of directing the supply of contaminants away from the bearing 70 may comprise directing the supply of contaminants radially outward from the bearing 70. The step 130 of directing the supply of contaminants away from the bearing 70 may comprise directing the supply of contaminants through at least one drain slot 43 positioned on an upstream facing side 71 of a bearing housing 72. The step 130 of directing the supply of contaminants away from the bearing 70 may comprise directing the supply of contaminants is a direction about perpendicular to the axis 91 of the rotating machine 30. The step 130 of directing the supply of contaminants away from the bearing 70 may comprise directing the supply of contaminants from a bearing housing depression 78 and towards a scroll 33. The step 130 of directing the supply of contaminants away from the bearing 70 may comprise directing the supply of contaminants spirally outward. The direction of the spiral may be in the direction of rotation of the impeller 32.

As can be appreciated by those skilled in the art, the present invention provides an improved apparatus and method to prevent water or waste migration to the bearings of a rotating machine. Further, an improved bearing sealing assembly is provided.

It should be understood, of course, that the foregoing relates to exemplary embodiments of the invention and that modifications may be made without departing from the spirit and scope of the invention as set forth in the following claims.

We claim:

1. An assembly for a bearing having a bearing housing comprising:

an upstream annular cavity positioned upstream from and in contact with said bearing;

a retainer in contact with said bearing housing, said retainer at least partially defines said upstream annular cavity; and a supply of hydrophobic grease positioned within said upstream annular cavity, wherein said bearing comprises a bearing for a rotating machine, and wherein said retainer has a radial clearance with an impeller hub of said rotating machine of less than about 0.005 inches.

2. The assembly of claim 1, wherein said retainer is integral to said bearing housing.

3. The assembly of claim 1, further comprising a downstream annular cavity positioned downstream from and in contact with said bearing.

4. The assembly of claim 3, wherein said downstream annular cavity includes a supply of hydrophobic grease.

5. The assembly of claim 1, further comprising a downstream annular cavity positioned downstream from and in contact with said bearing, said downstream annular cavity at least partially defined by an o-ring.

6. The assembly of claim 5, wherein a radial length of said downstream annular cavity is about equal to a radial length of said bearing.

7. The assembly of claim 1, further comprising at least one drain slot machined into an upstream facing side of said bearing housing.

8. The assembly of claim 7, wherein said at least one drain slot comprises between about one and about twenty drain slots.

9. The assembly of claim 1, wherein said retainer is pressed into said bearing housing.

10. An assembly for a rotating machine having a bearing and an impeller comprising:

at least one drain slot machined into a housing of the bearing, said drain slot extending outward from a bearing housing depression in said housing and towards a scroll of said rotating machine; and a retainer in contact with the bearing housing, wherein the retainer has a radial clearance with an impeller hub of said rotating machine of less than about 0.005 inches.

11. The assembly of claim 10, wherein said at least one drain slot is perpendicular to an axis through said rotating machine.

12. The assembly of claim 10, wherein said at least one drain slot is cantered.

13. The assembly of claim 10, wherein said at least one drain slot extends radially outward.

14. The assembly of claim 10, wherein said at least one drain slot extends spirally in the direction of rotation of said impeller.

15. A method of preventing the migration of a supply of contaminants into a bearing of a rotating machine comprising the steps of:

sealing a downstream side of said bearing;

sealing an upstream side of said bearing; and directing said supply of contaminants away from said bearing.

16. The method of claim 15, wherein said step of sealing an upstream side of said bearing includes positioning a retainer in contact with a housing of said bearing such that said retainer has a radial clearance with an impeller hub of said rotating machine between about 0.0001 inches and about 0.010 inches.

17. The method of claim 15, wherein said step of directing said supply of contaminants away from said bearing comprises directing said supply of contaminants through at least one drain slot positioned on an upstream facing side of a bearing housing of said rotating machine.

18. The method of claim 15, wherein said step of directing said supply of contaminants away from said bearing comprises directing said supply of contaminants from a bearing housing depression of said rotating machine and towards a scroll of said rotating machine.

* * * * *